US011603281B2

(12) United States Patent
Iwama et al.

(10) Patent No.: US 11,603,281 B2
(45) Date of Patent: Mar. 14, 2023

(54) SHEET PROCESSING APPARATUS

(71) Applicants: Satoshi Iwama, Yamanashi-ken (JP); Toshikazu Tanaka, Yamanashi-ken (JP)

(72) Inventors: Satoshi Iwama, Yamanashi-ken (JP); Toshikazu Tanaka, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/467,779

(22) Filed: Sep. 7, 2021

(65) Prior Publication Data

US 2022/0073304 A1 Mar. 10, 2022

(30) Foreign Application Priority Data

Sep. 7, 2020 (JP) ..... JP2020-149890

(51) Int. Cl.
*B65H 29/14* (2006.01)
*B65H 31/26* (2006.01)

(52) U.S. Cl.
CPC ..... *B65H 29/14* (2013.01); *B65H 31/26* (2013.01); *B65H 2801/27* (2013.01)

(58) Field of Classification Search
CPC ..... B41L 43/12; B41F 13/66; B31F 5/001; B42C 1/12; G03G 2215/00827; G03G 2215/00864; B65H 37/04; B65H 2801/27; B65H 31/26; B65H 29/14; B65H 29/22; B65H 29/18
USPC ..... 271/273
See application file for complete search history.

(56) References Cited

U.S. PATENT DOCUMENTS 5,137,265 A * 8/1992 Sato ..... B42C 1/12 270/58.12
5,462,265 A * 10/1995 Mandel ..... B65H 31/36 414/789.9
5,478,061 A * 12/1995 Murakami ..... G03G 15/6538 270/58.08
6,962,331 B2 * 11/2005 Matsumoto ..... B65H 33/08 270/58.11
7,255,340 B2 * 8/2007 Anezaki ..... B65H 31/3027 270/58.11

(Continued)

FOREIGN PATENT DOCUMENTS

JP 2009-126658 A 6/2009
JP 2009-263027 A 11/2009

(Continued)

*Primary Examiner* — Leslie A Nicholson, III
(74) *Attorney, Agent, or Firm* — Manabu Kanesaka

(57) ABSTRACT

A sheet processing apparatus for processing sheets includes: a stack tray on which a sheet is stacked; a discharge roller pair composed of first and second rollers and configured to discharge a sheet onto the stack tray, the second roller being configured to be movable between a pressure contact position to contact with the first roller and a retracting position to separate from the first roller; and a pressure contact/separation mechanism for moving the second roller from the retracting position to the pressure contact position. The pressure contact/separation mechanism changes the timing at which the second roller reaches the pressure contact position according to the type of a sheet to be discharged.

11 Claims, 8 Drawing Sheets

(56) References Cited

U.S. PATENT DOCUMENTS

| | | | | |
|---|---|---|---|---|
| 7,552,917 | B2 * | 6/2009 | Hayashi | G03G 15/6538 271/189 |
| 8,226,080 | B2 * | 7/2012 | Morita | B65H 31/36 270/58.12 |
| 8,439,342 | B2 * | 5/2013 | Okamoto | B65H 39/00 270/58.11 |
| 8,690,142 | B2 * | 4/2014 | Nagata | G03G 15/6544 270/58.04 |
| 8,899,579 | B2 * | 12/2014 | Gamo | B65H 31/34 271/220 |
| 9,409,735 | B2 * | 8/2016 | Abe | B65H 5/026 |

FOREIGN PATENT DOCUMENTS

| | | | |
|---|---|---|---|
| JP | 2010-202383 | A | 9/2010 |
| JP | 2013-047125 | A | 3/2013 |

* cited by examiner

S···Sheet
Sa···Front end
21b···Stack tray
27···Discharge roller pair

SHEET PROCESSING APPARATUS

BACKGROUND OF THE INVENTION

Field of the Invention

The present invention relates to a sheet processing apparatus capable of selecting an optimum sheet discharge mode based on a sheet type.

Description of the Related Art

There are conventionally known sheet processing apparatuses configured to discharge sheets on which images have been formed by an image forming apparatus, such as a printer or a scanner, to a stack tray without applying additional processing thereto or after applying post-processing, such as stapling, to the image-formed sheets (see JP 2009-263027A, JP 2009-126658A). A sheet processing apparatus of this type is provided with a conveying roller pair for conveying a sheet onto a processing tray and a forward/reverse rotatable discharge roller pair for discharging, at a sheet carry-out port, a sheet to a stack tray. Further, such a sheet processing apparatus can operate in a non-stapling mode to discharge a sheet fed from the conveying roller pair directly to a stack tray by means of the discharge roller pair which is in a pressure contact state and a stapling mode to apply post-processing, such as stapling, after switching back a plurality of sheets (sheet bundle) discharged onto a processing tray, and store the resultant sheets on the stack tray.

The sheet processing apparatuses disclosed in JP 2009-263027A and JP 2009-126658A are configured to make the sheet from the conveying roller pair fall onto the processing tray. However, the absence of a lower guide for guiding the sheet to a pressure contact part of the discharge roller pair may cause a problem depending on the sheet conveyance condition or sheet type where the front end of the sheet collides with the circumferential surface of the discharge roller pair, preventing smooth discharge of the sheet.

SUMMARY OF THE INVENTION

A sheet processing apparatus includes: a stack tray on which a sheet is stacked; a discharge roller pair composed of first and second rollers and configured to discharge a sheet onto the stack tray, the second roller being configured to be movable between a pressure contact position to contact with the first roller and a retracting position to separate from the first roller; and a pressure contact/separation mechanism for moving the second roller from the retracting position to the pressure contact position. The pressure contact/separation mechanism changes the timing at which the second roller reaches the pressure contact position according to the type of a sheet to be discharged.

DETAILED DESCRIPTION OF THE PREFERRED EMBODIMENTS

Figure 1:
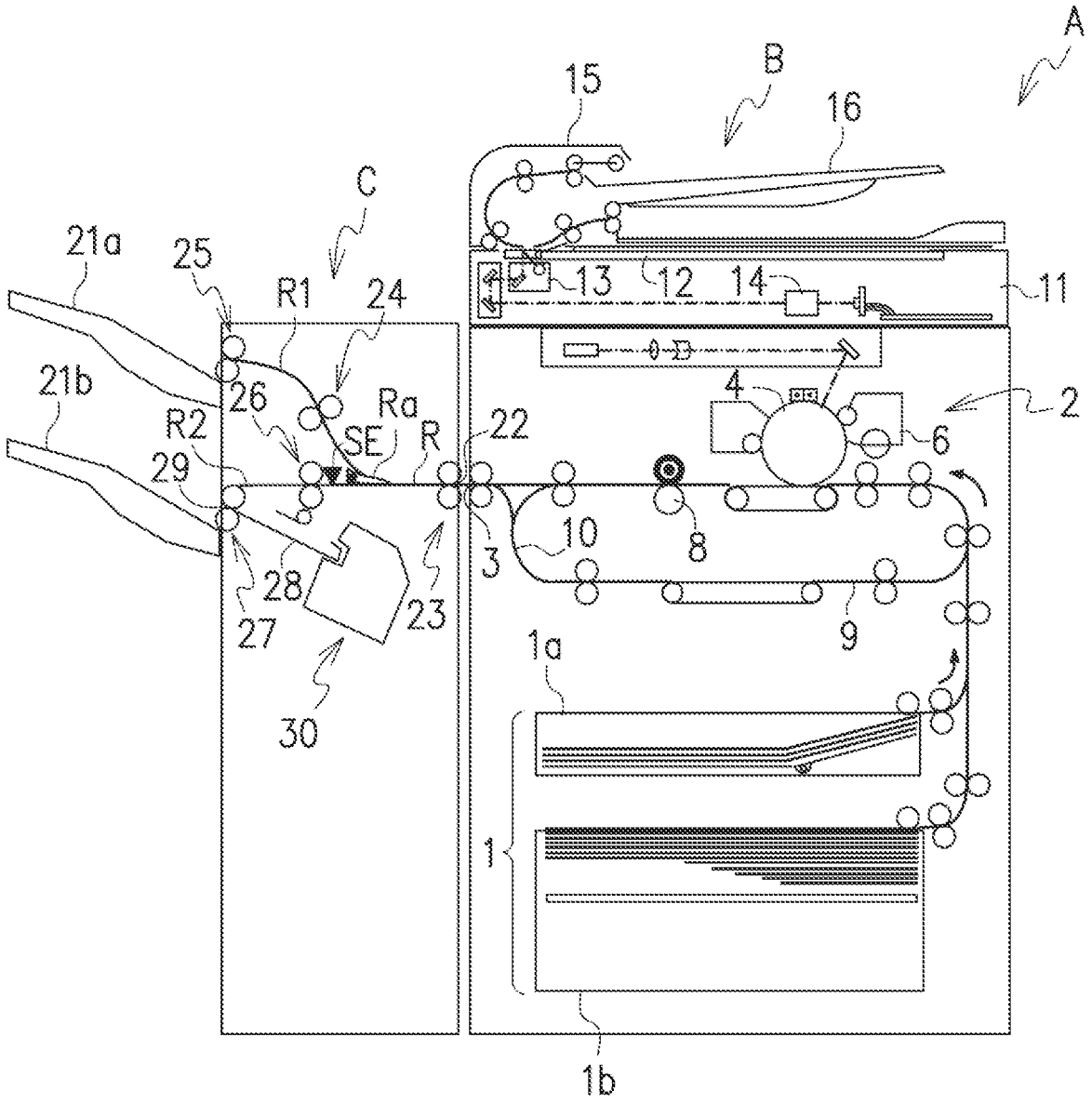
FIG. 1 is a cross-sectional view of an image forming system including a sheet processing apparatus according to the present invention.

Hereinafter, an embodiment of the present invention will be described in detail with reference to the accompanying drawings. First, with reference to FIG. 1, the outline of an image forming system A, including a sheet processing apparatus C of the present invention will be described.

The image forming system A is composed of an image forming apparatus B and the sheet processing apparatus C. The image forming apparatus B and the sheet processing apparatus C are connected to each other through a carry-out port 3 of the image forming apparatus B and a carry-in port 22 of the sheet processing apparatus C. A sheet on which an image has been formed by the image forming apparatus B is discharged onto a stack tray 21*a* or 21*b* passing through the sheet processing apparatus C.

The image forming apparatus B is configured to feed a sheet from a sheet supply part 1 to an image forming part 2, print an image on the sheet in the image forming part 2, and discharge the resultant sheet through the carry-out port 3. In the sheet supply part 1, sheets with different sizes are stored in sheet cassettes 1*a* and 1*b*, and designated sheets are separated one from another and fed to the image forming part 2. The image forming part 2 is provided with, for example, an electrostatic drum 4, and a print head (not illustrated), a developing unit 6, a transfer charger 7 and a fixing unit 8 which are disposed around the electrostatic drum 4. Image formation on a sheet is performed as follows: an electrostatic latent image is formed on the electrostatic drum 4, added with toner by the developing unit 6, transferred onto the sheet by the transfer charger 7, followed by heating by the fixing unit 8, whereby an image is formed on the sheet. The sheet with the image thus formed is sequentially carried out toward the sheet processing apparatus C through the s carry-out port 3. In a circulating path 9, a sheet, on the front surface of which has been subjected to image formation and fed from the fixing unit 8 is face-reversed in a switchback path 10 and is fed again to the image forming part 2, whereby double-sided printing is achieved. The double-sided printed sheet is face-reversed in the switchback path 10 and carried out toward the sheet processing apparatus C through the carry-out port 3.

An image reading device 11 scans a document sheet set on a platen 12 by means of a scan unit 13 and electrically reads the document sheet by means of a photoelectric conversion element 14. The read image data is subjected to, e.g., digital processing by an image processing part (not illustrated). A document feeder 15 feds a document sheet set on a stack tray 16 to the platen 12.

The thus configured image forming apparatus B is provided with a control part (not illustrated). The control part sets image forming conditions, for example, printing conditions such as designation of sheet size, designation of color/monochrome printing, designation of the number of copies to be printed, designation of single sided/double sided printing, and designation of enlarged/reduced printing.

The sheet processing apparatus C according to the present invention is provided with a normal discharge unit that directly discharges a sheet carried in through the carry-in port 22 by way of a carry-in roller pair 23, a post-processing unit that is disposed on one end side on a processing tray 28 and applies stapling to a sheet at a stapling position on the processing tray 28, and a control unit for controlling the sheet post-processing and sheet discharge. The normal discharge unit selectively discharges a sheet with an image formed by the image forming apparatus B to the stack tray 21*a* or 21*b*. The post-processing unit according to the present embodiment, which is provided with a stapling unit 30, applies stapling to a sheet bundle with images formed by the image forming apparatus B and discharges the bound sheet bundle to the stack tray 21*b*.

A conveying path R extends downward in a sheet conveying direction from the carry-in port 22 and is branched into a first discharge path R1 directed to the upper stack tray 21*a* and a second discharge path R2 directed to the lower stack tray 21*b* through a flapper Ra. The first discharge path R1 is provided with a first conveying roller pair 24 arranged on the upstream side and a first discharge roller pair 25 arranged downstream from the first conveying roller pair 24. The second discharge path R2 is provided with a second conveying roller pair 26 arranged on the upstream side and a second discharge roller pair 27 arranged downstream from the second conveying roller pair 26. The second discharge roller pair 27 is positioned at a carry-out port 29. The second conveying roller pair 26 is disposed above the processing tray 28 and conveys a sheet onto the processing tray 28. The second discharge roller pair 27 is disposed on the other end side of the processing tray 28 and discharges a sheet that has been subjected to post-processing on the processing tray 28 and a sheet from the second conveying roller pair 26.

The first conveying roller pair 24 and the first discharge roller pair 25 are each composed of a drive motor rotated by a not-shown drive motor and a driven roller rotated following the drive roller and each discharge a sheet toward the stack tray 21*a* in a pressure contact state.

Figure 2:
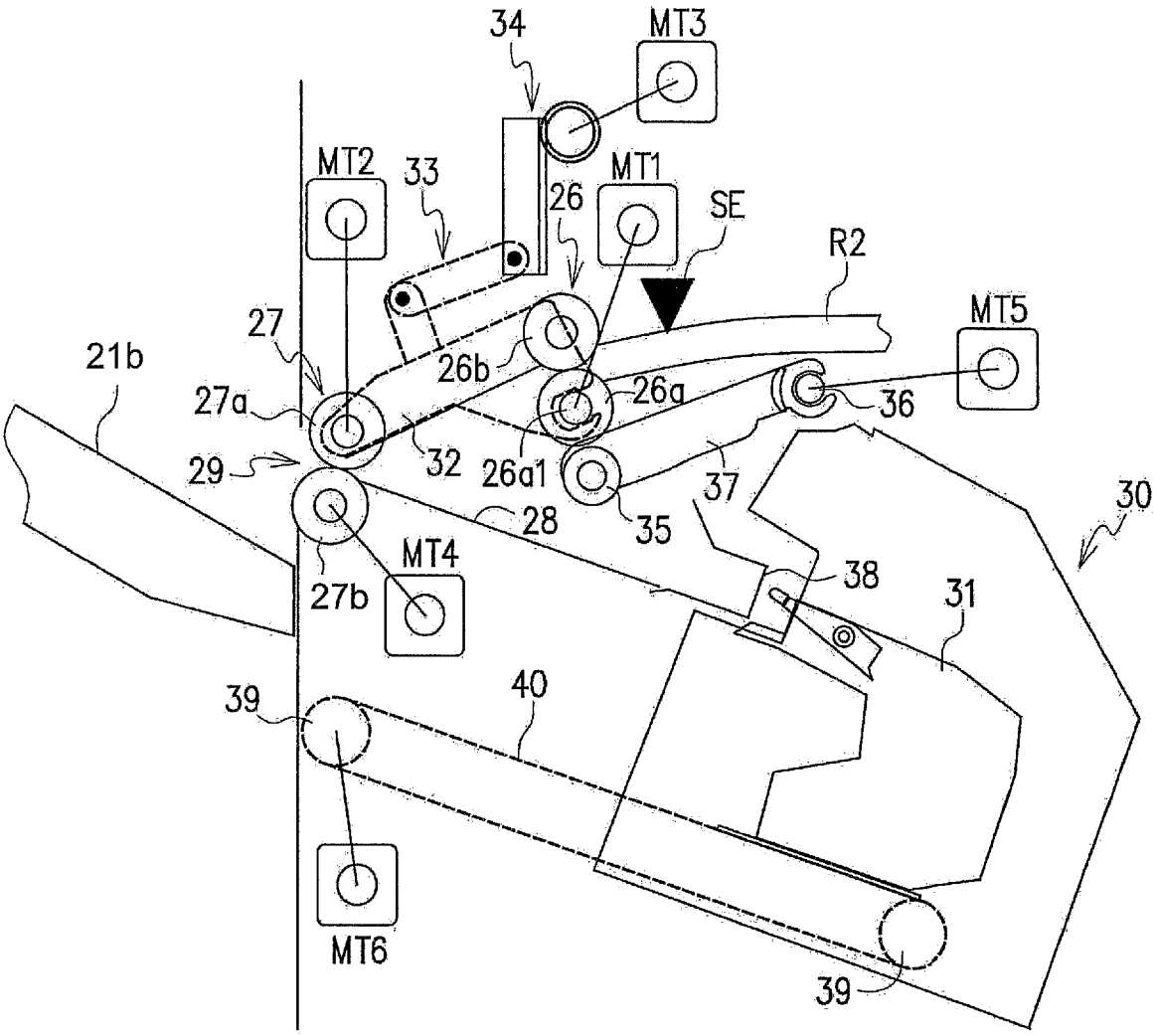
FIG. 2 is a cross-sectional view illustrating the main configuration inside the sheet processing apparatus.

As illustrated in FIG. 2, the second conveying roller pair 26 is composed of a drive roller 26*a* rotated by a conveying motor MT1 and a driven roller 26*b* rotated following the drive roller 26*a*. The second discharge roller pair 27 is composed of an upper drive roller 27*a* rotated by a discharge motor MT2 and a lower drive roller 27*b* rotated by a switchback motor MT4.

The upper drive roller 27*a* of the second discharge roller pair 27 is fitted to one end of a first arm 32 which is swingable about a rotary shaft 26*a*1 of the drive roller 26*a* of the second conveying roller pair 26. The first arm 32 is connected to a pressure contact motor MT3 through a link member 33 and a rack-and-pinion member 34. Driving the pressure contact motor MT3 allows the upper drive roller 27*a* to be vertically moved between a pressure contact position to be brought into pressure contact with the lower drive roller 27*b* and a waiting position separated therefrom.

Besides, as a mechanism concerning the stapling unit 30, there is provided a raking roller 35 configured to be brought into pressure contact with a sheet conveyed onto the processing tray 28 to guide the sheet to the stapling unit 30. The processing tray 28 is formed of a synthesis resin plate and has an upper surface serving as a sheet support surface 28*a* on which sheets are stacked and supported. The sheet support surface 28*a* is present on the downstream side relative to the second conveying roller pair 26 with a level difference formed therebetween, and sheets from the second conveying roller pair 26 are stored and stacked thereon. As illustrated in FIG. 2, the sheet support surface 28*a* is formed to have a length shorter than a sheet length in the sheet discharge direction, so that the rear end of a sheet from the carry-out port 29 is supported by the sheet support surface 28*a*, while the front end of the sheet is supported on the uppermost one of the sheets on the stack tray 21*b*. The raking roller 35 is fitted to one end of a second arm 37 which is swingable about a rotary shaft 36 rotated by an elevation motor MT5. Normally, the raking roller 35 stays on standby at a location above the processing tray 28 and lowers to abut against the surface of a sheet carried in the processing tray 28 by the reverse rotation of the second discharge roller pair 27 to make the rear end of the sheet abut against an alignment plate 38 in the stapling unit 30 for alignment. The sheet bundle thus aligned is held by a gripper 31 as illustrated in FIG. 5D after being subjected to stapling by the stapling unit 30 and is then discharged onto the stack tray 21*b*. A conveying belt 40 is installed over a pair of pulleys 39 and moves the gripper 31 by receiving the drive of a belt motor MT6. The details of stapling processing will be omitted.

In the second discharge path R2, a sheet sensor SE is provided in the vicinity of the upstream side relative to the second conveying roller pair 26. The sheet sensor SE detects the front end of a sheet fed along the second discharge path R2.

The sheet processing apparatus C according to the present invention can operate in a stapling mode to apply post-processing (stapling) to a sheet conveyed from the second conveying roller pair 26 on the processing tray 28 and discharge the resultant sheet onto the stack tray 21*b* by means of the gripper 31 and in a non-stapling mode to discharge a sheet fed from the second conveying roller pair 26 directly onto the stack tray 21*b* by means of the second discharge roller pair 27. In the present embodiment, upon sheet discharge onto the second stack tray 21*b* in the non-stapling mode, the second discharge roller pair 27 is switched from a separated state to a pressure contact state, and the timing at which the second discharge roller pair 27 is brought into a pressure contact state is changed according to the sheet type (regular sheet, envelope). Specifically, in the case of an envelope, at the timing when the front end of the envelope reaches a predetermined position between a pressure contact position P2 of the second discharge roller pair 27 and the second stack tray 21*b*, the second discharge roller pair 27 is brought into a pressure contact state. On the other hand, in the case of a sheet other than an envelope, the second discharge roller pair 27 is brought into a pressure contact state after the front end of the sheet reaches the second stack tray 21*b*.

In the case of the envelope, the envelope is discharged onto the second stack tray 21*b* with the front surface side thereof faced downward; however, when the discharge on the second stack tray 21*b* is performed in a state where the second discharge roller pair 27 is in a separated state, a front end Sa of a succeeding envelope S collides with a flap part Sf of an envelope S that has already been stored on the stack tray 21*b*. To cope with this, in the present invention, the envelope S is nipped by the second discharge roller pair 27 before it is discharged onto the second stack tray 21*b*, thus preventing collision with the flap part Sf of the preceding envelope S.

Figure 3A:
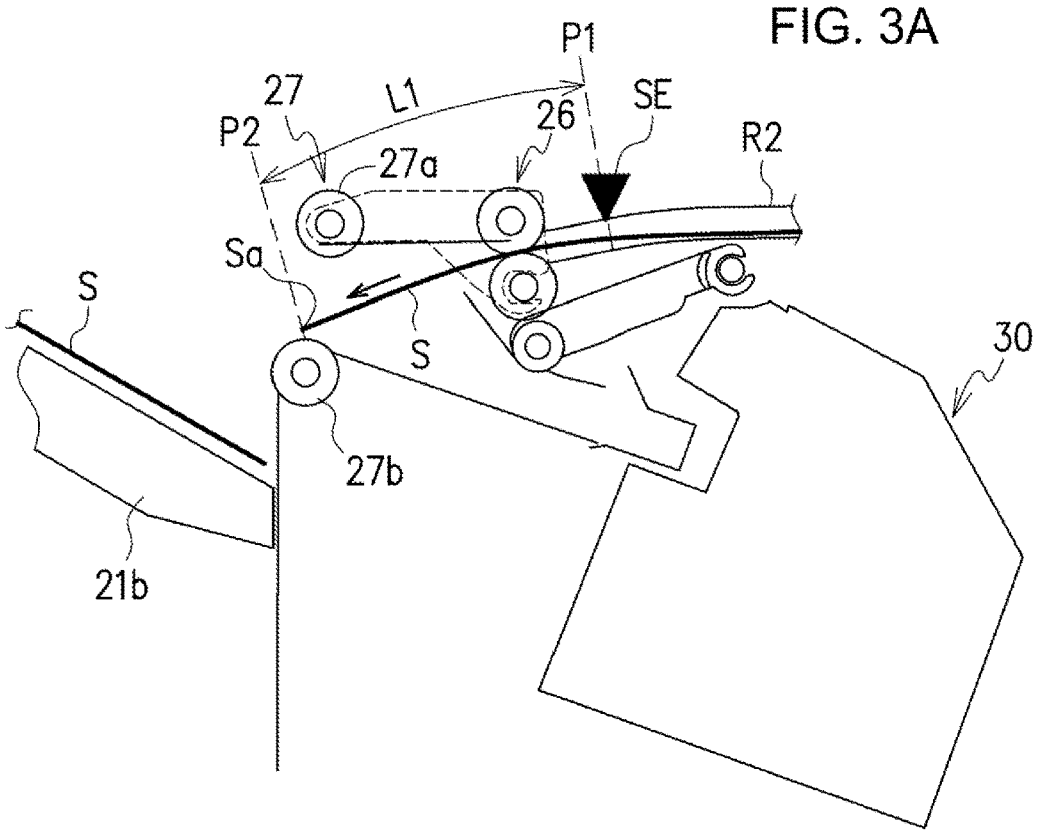
FIG. 3A is an explanatory view illustrating a discharge operation (1) to discharge a regular sheet in a non-stapling mode.
Figure 3B:
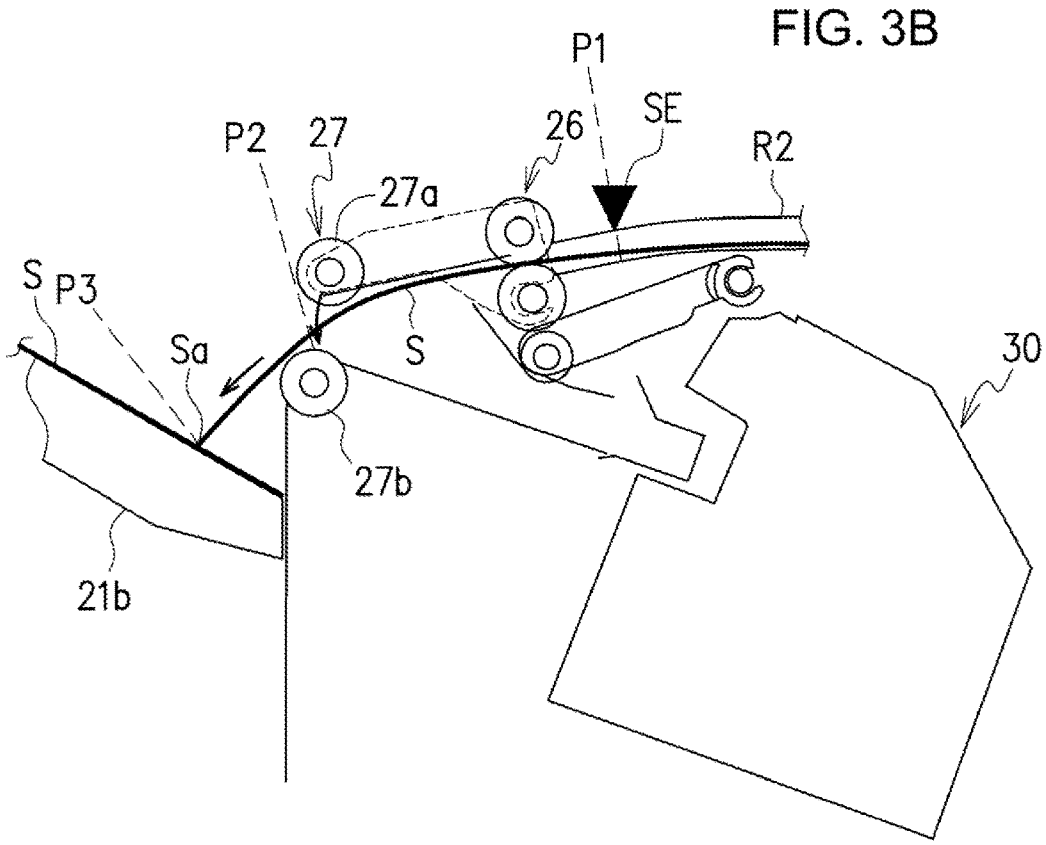
FIG. 3B is an explanatory view illustrating a discharge operation (2) to discharge a regular sheet in a non-stapling mode.
Figure 3C:
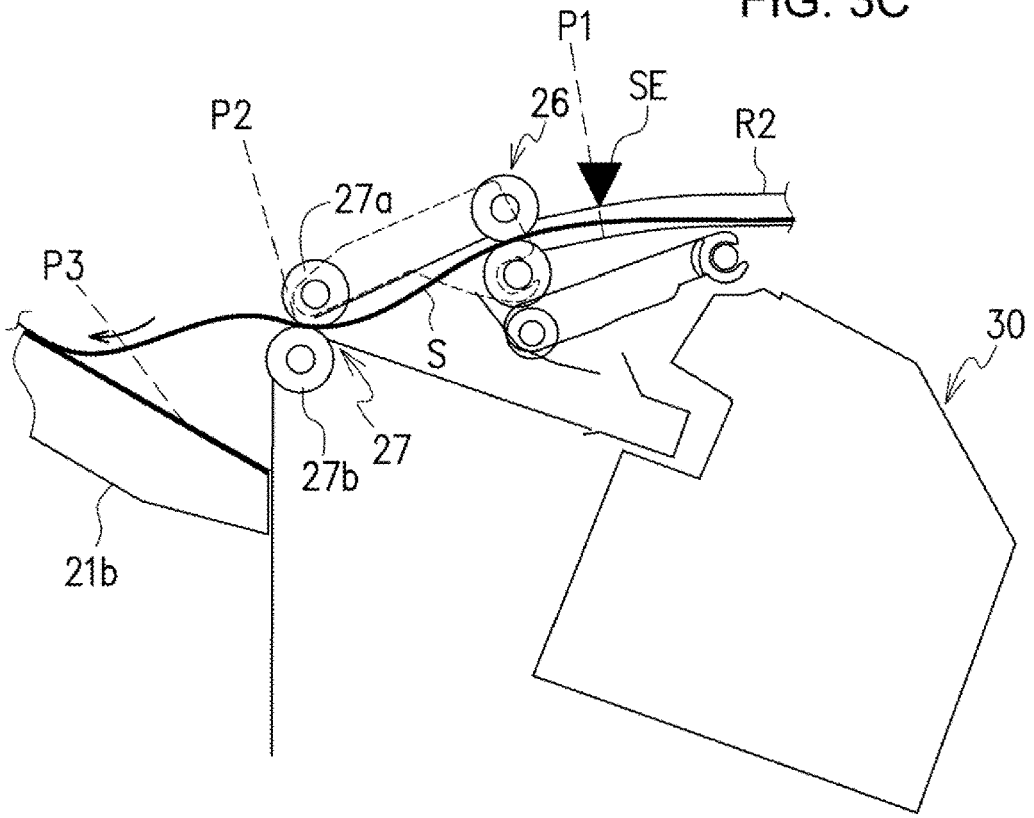
FIG. 3C is an explanatory view illustrating a discharge operation (3) to discharge a regular sheet in a non-stapling mode.

FIGS. 3A to 3C illustrate a discharge operation of a sheet (regular sheet) other than a specific sheet in the non-stapling mode. As illustrated in FIG. 3A, the upper drive roller 27*a* is at the waiting position separated from the lower drive roller 27*b* and, in this state, a front end Sa of a sheet S is fed to the vicinity of the pressure contact position P2 of the second discharge roller pair 27. Then, as illustrated in FIG. 3B, the pressure contact motor MT3 starts driving to lower the upper drive roller 27*a* toward the lower drive roller 27*b*. During this time, the front end Sa of the sheet S is fed to a position P3 to reach the surface of the stack tray 21*b*. Then, as illustrated in FIG. 3C, at the timing when the front end Sa of the sheet S is placed on the second stack tray 21*b*, the second discharge roller pair 27 nips the sheet S. That is, for sheets other than an envelope, the second discharge roller pair 27 is brought into a pressure contact state after the front end Sa of the sheet S reaches the second stack tray 21*b*.

Figure 4A:
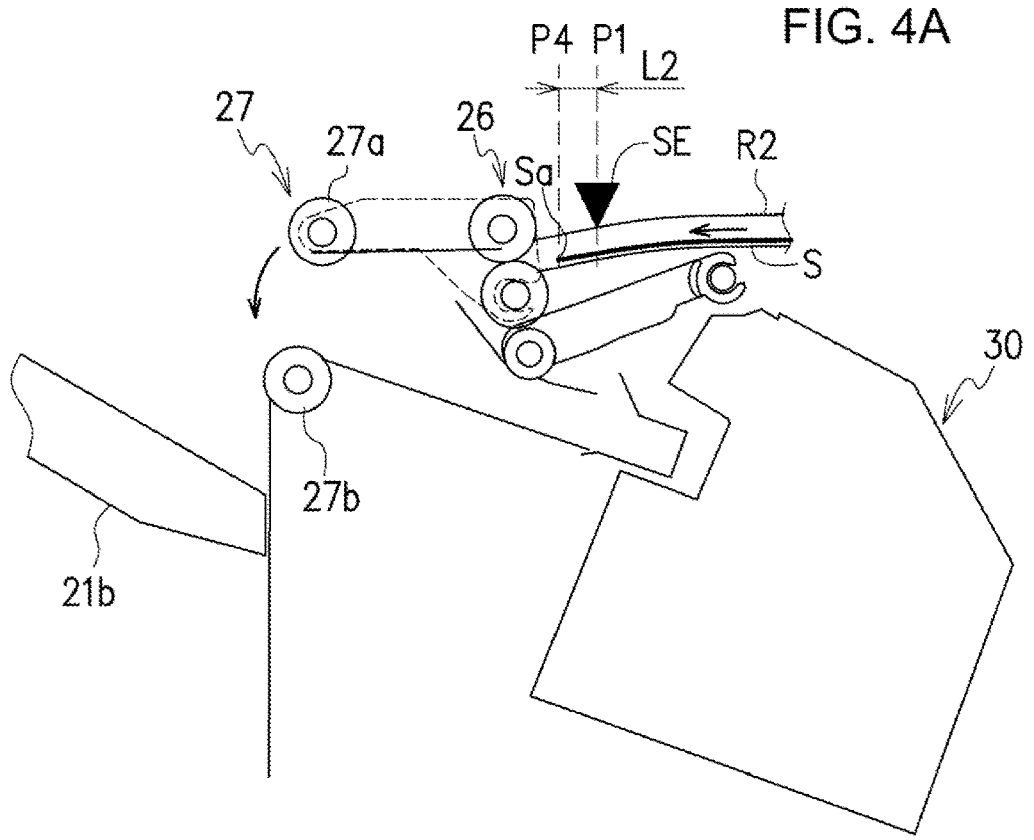
FIG. 4A is an explanatory view illustrating a discharge operation (1) to discharge an envelope in a non-stapling mode.
Figure 4B:
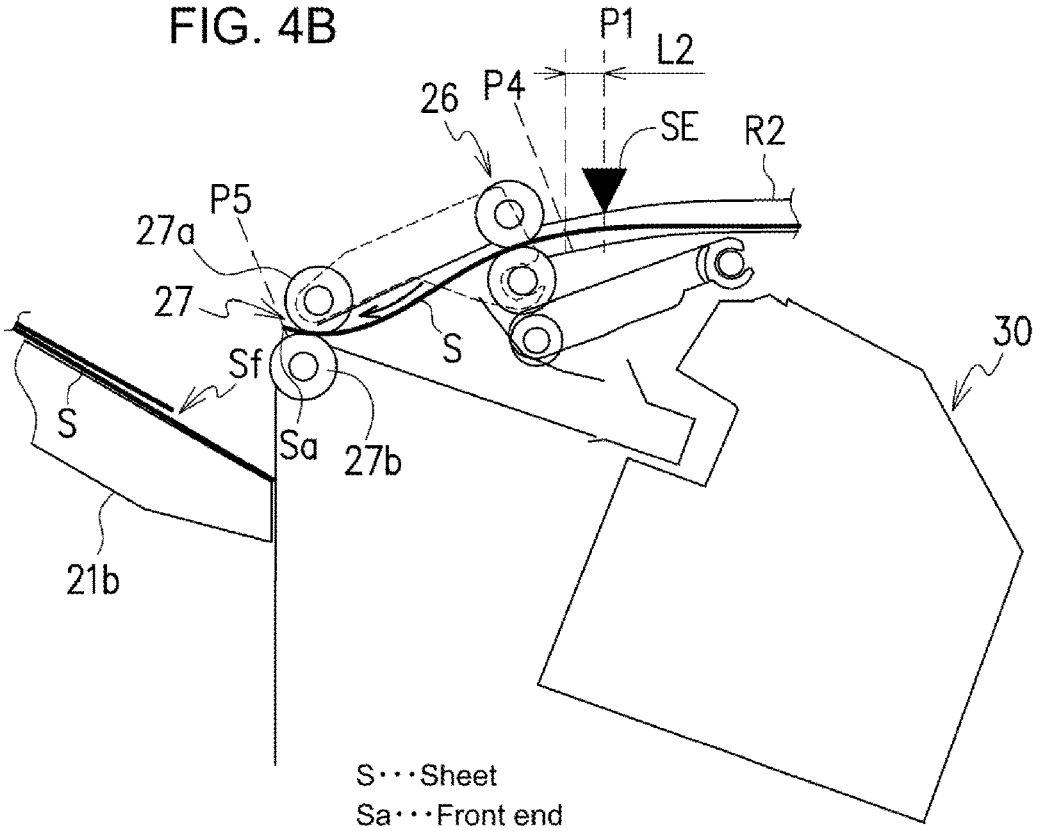
FIG. 4B is an explanatory view illustrating a discharge operation (2) to discharge an envelope in a non-stapling mode.
Figure 4C:
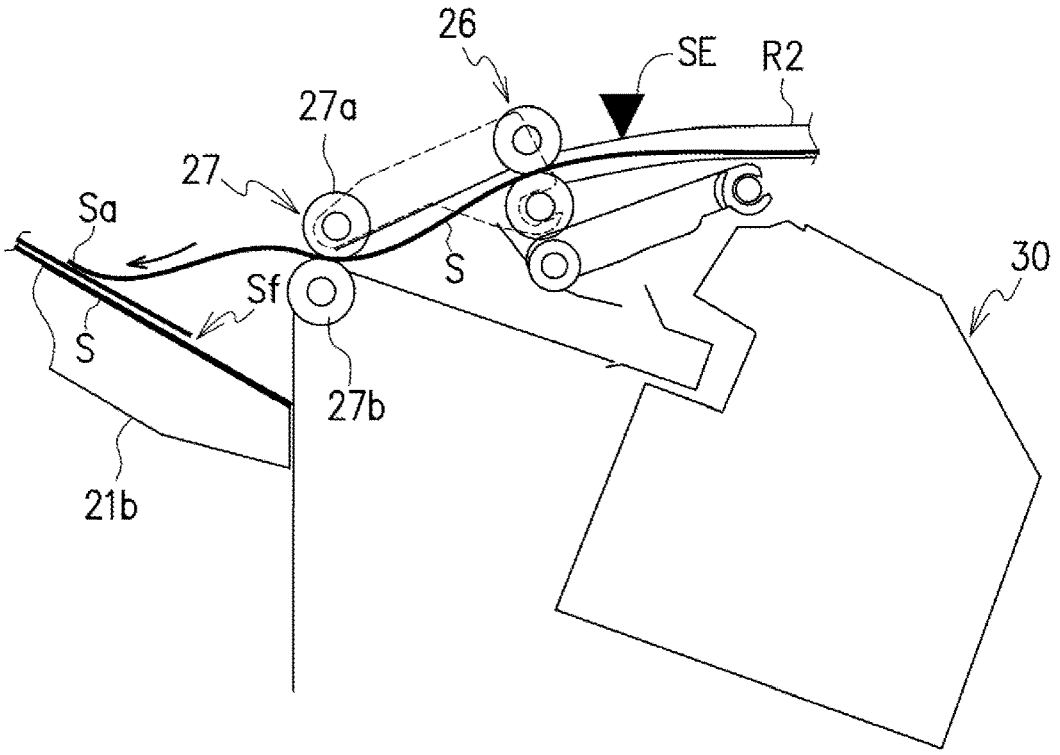
FIG. 4C is an explanatory view illustrating a discharge operation (3) to discharge an envelope in a non-stapling mode.

FIGS. 4A to 4C illustrate a discharge operation of a specific sheet (envelope) in the non-stapling mode. As illustrated in FIG. 4A, the upper drive roller 27*a* is at the waiting position separated from the lower drive roller 27*b* and, in this state, the front end Sa of the sheet (envelope) S is fed to a position P4 before the second conveying roller pair 26. Then, as illustrated in FIG. 4B, the pressure contact motor MT3 starts driving to lower the upper drive roller 27*a* toward the lower drive roller 27*b*. During this time, the front end Sa of the envelope S reaches the second discharge roller pair 27, and the upper drive roller 27*a* and the lower drive roller 27*b* are brought into pressure contact with each other to nip the envelope S at a position slightly past the pressure contact position P2 of the second discharge roller pair 27. That is, for the envelope, the second discharge roller pair 27 is brought into a pressure contact state before the front end Sa of the envelope S reaches the stack tray 21*b*. Thereafter, as illustrated in FIG. 4C, a succeeding envelope S is discharged smoothly without colliding with or caught on the flap part Sf of a preceding envelope S.

Figure 5A:
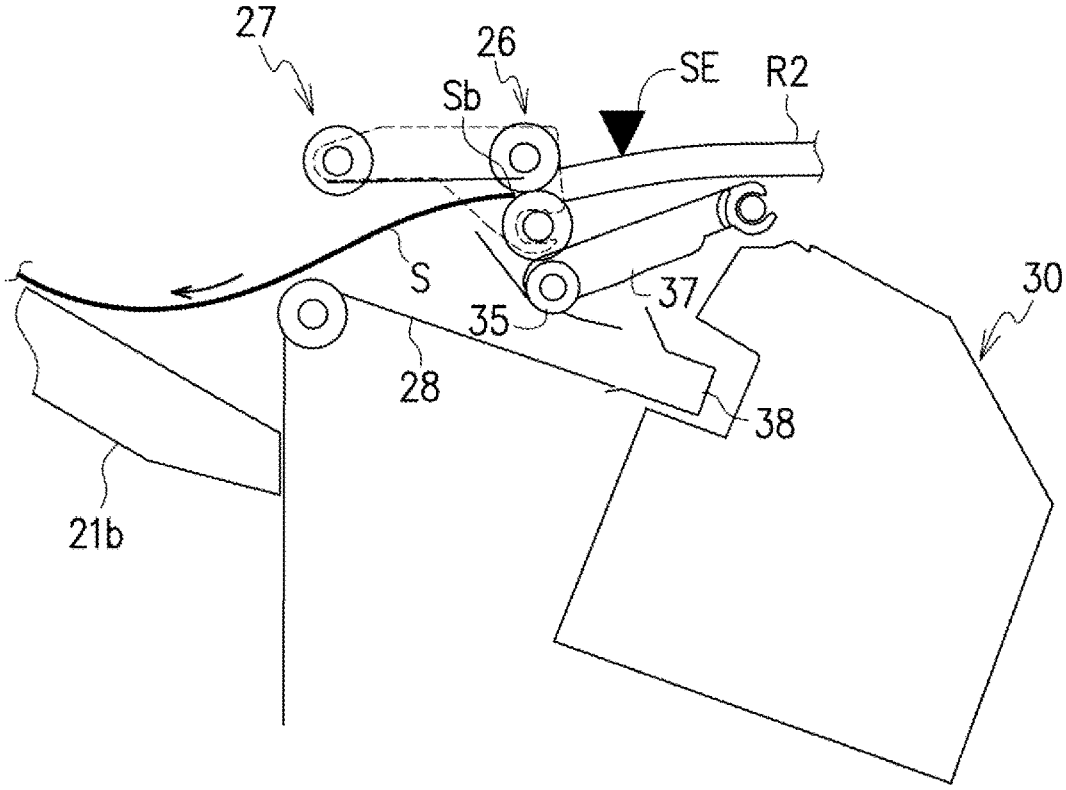
FIG. 5A is an explanatory view illustrating a discharge operation (1) in a stapling mode.
Figure 5B:
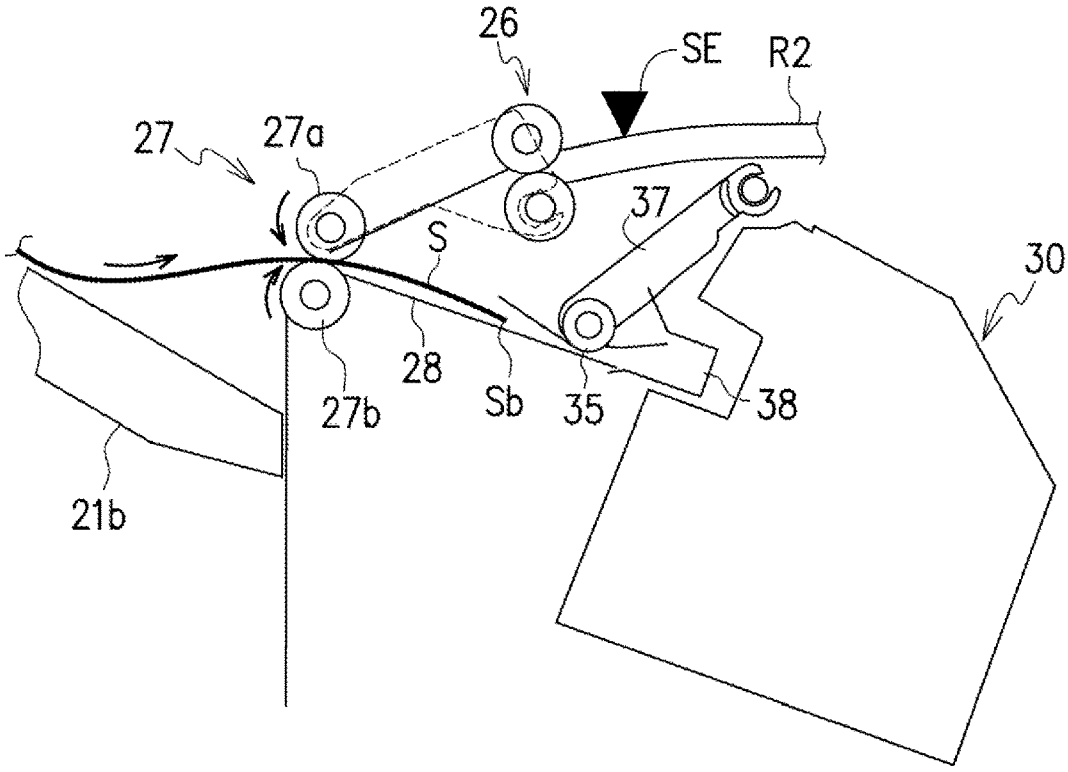
FIG. 5B is an explanatory view illustrating a discharge operation (2) in a stapling mode.
Figure 5C:
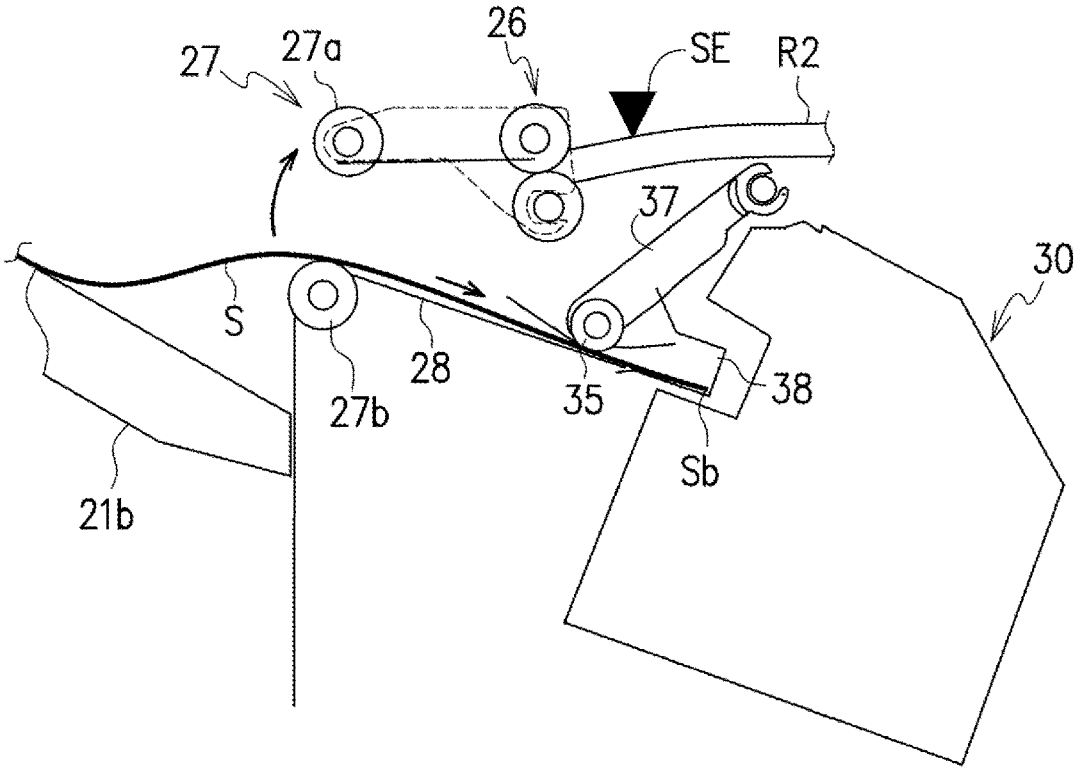
FIG. 5C is an explanatory view illustrating a discharge operation (3) in a stapling mode.
Figure 5D:
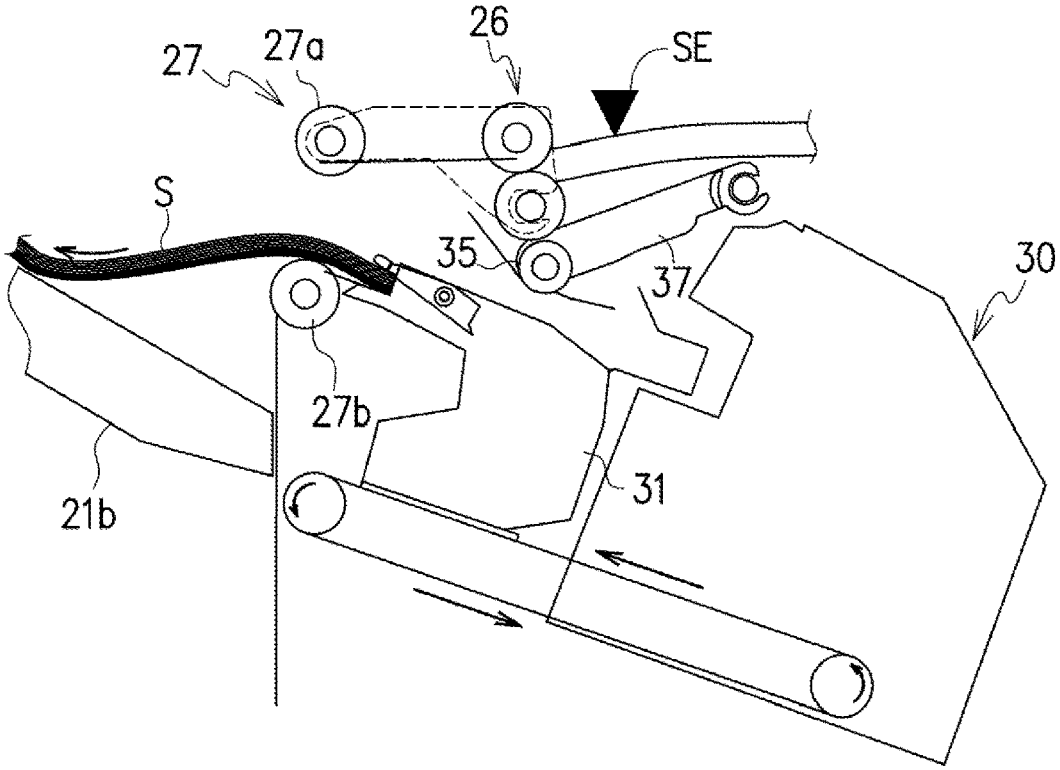
FIG. 5D is an explanatory view illustrating a discharge operation (4) in a stapling mode.

FIGS. 5A to 5D illustrate a sheet raking operation and a sheet discharge operation in the stapling mode. As illustrated in FIG. 5A, the sheet S is fed by the second conveying roller pair 26 until the front end Sa thereof reaches the stack tray 21*b* with the second discharge roller pair 27 kept in a separated state. Then, as illustrated in FIG. 5B, after a rear end Sb of the sheet S passes the second conveying roller pair 26 and falls on the processing tray 28, the second discharge roller pair 27 is brought into a pressure contact state, and the upper and lower drive rollers 27*a* and 27*b* are each rotated in a direction opposite to the sheet discharge direction. At this time, the raking roller 35 is lowered by the drive of the elevation motor MT5 and guides the sheet S on the processing tray 28 to the alignment plate 38 of the stapling unit 30 to position the sheet S at a stapling position, as illustrated in FIG. 5C. Then, after completion of the alignment of a predetermined number of sheets S, stapling processing is performed using the stapling unit 30. Thereafter, as illustrated in FIG. 5D, the belt motor MT6 is driven to move the gripper 31 toward the stack tray 21*b* to discharge a bundle of the bound sheets S onto the stack tray 21*b*.

Figure 6:
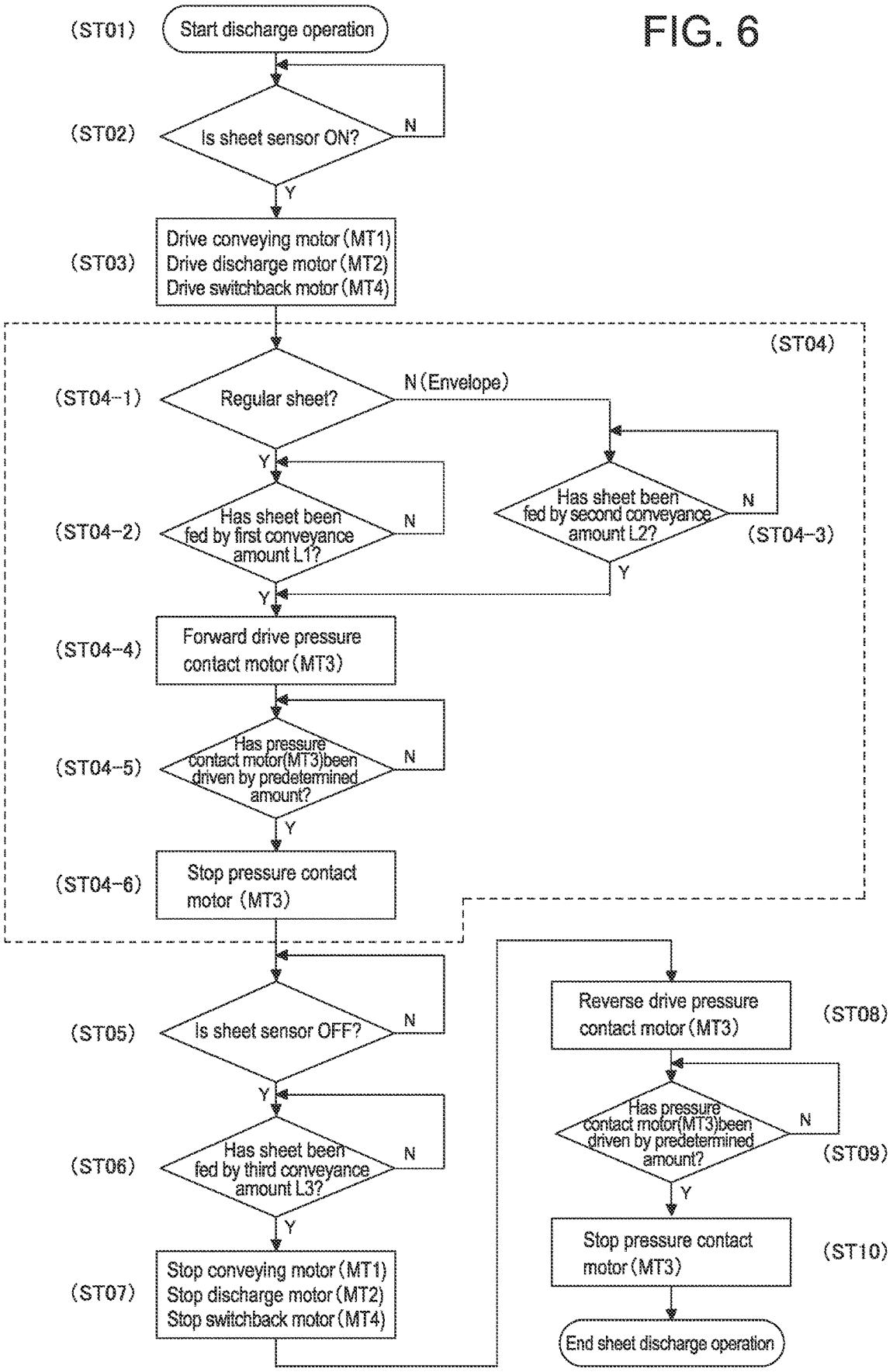
FIG. 6 is a flowchart of the discharge operation of a regular sheet and an envelope in a non-stapling mode.

Hereinafter, a discharge operation of a sheet (regular sheet, envelope) in the non-staple mode will be described in detail based on a flowchart illustrated in FIG. 6 with reference to FIGS. 3A to 3C and 4A to 4C.

A regular sheet or an envelope is conveyed from the image forming apparatus B to the sheet processing apparatus C (sheet discharge operation from the image forming apparatus B) (ST01). At this point of time, the non-stapling mode has been designated by the image forming apparatus B. When the sheet from the image forming apparatus B is detected by the sheet sensor SE, the conveying motor MT1, discharge motor MT2, and switchback motor MT4 are driven (ST02 to ST03). Then, the second discharge roller pair 27 is brought into a pressure contact state (ST04). In this pressure contact operation, whether a sheet to be fed is a regular sheet or an envelope is first determined (ST04-1).

When the type of the sheet is a regular sheet, the pressure contact motor MT3 starts forward driving at the point of time when the sheet is fed by a first conveyance amount L1 from when the front end of the sheet is detected by the sheet sensor SE (ST04-2, ST04-4) (see FIG. 3A). Then, the pressure contact motor MT3 is stopped at the point of time when it is driven by a predetermined amount (ST04-5, ST04-6). As a result, the upper drive roller 27*a* is moved from the waiting position to the pressure contact position to bring the upper and lower drive rollers 27*a* and 27*b* into pressure contact with each other. In the course of the movement of the upper drive roller 27*a*, the front end of the sheet reaches the stack surface of the stack tray 21*b* (see FIG. 3B) before the upper drive roller 27*a* reaches the pressure contact position, with the result that the front end Sa of the sheet S is placed on the stack surface of the stack tray 21*b* (see FIG. 3C). The first conveyance amount L1 is an amount corresponding to the distance between a detection position P1 of the sheet sensor SE and the vicinity of the downstream side of the pressure contact position P2 of the second discharge roller pair 27 (see FIG. 3A).

On the other hand, when the type of the sheet is an envelope, the pressure contact motor MT3 starts forward driving at the point of time when the sheet is fed by a second conveyance amount L2 from when the front end Sa of the sheet S is detected by the sheet sensor SE (ST04-3, ST04-4) (see FIG. 4A). Then, the pressure contact motor MT3 is stopped at the point of time when it is driven by the predetermined amount (ST04-5, ST04-6). As a result, the upper drive roller 27*a* is moved from the waiting position to the pressure contact position to bring the upper and lower drive rollers 27*a* and 27*b* into pressure contact with each other. At this time, the front end Sa of the sheet S is positioned downstream slightly popped out of the pressure contact position P2 of the second discharge roller pair 27 which is brought into a pressure contact state and does not reach the stack surface of the second stack tray 21*b* (see FIG. 4B). Thus, in the case of the envelope, the front end of the sheet is fed onto the second stack tray 21*b* after the second discharge roller pair 27 is brought into a pressure contact state (see FIG. 4C).

The second discharge roller pair 27 (specifically, the upper drive roller 27*a*) is normally at the waiting position, so that the second discharge roller pair 27 is already in a separated state when the front end Sa of the sheet S is detected by the sheet sensor SE. Then, when the rear end Sb of the sheet S is detected by the sheet senor SE after completion of the pressure contact operation of the second discharge roller pair 27, the sheet S is fed by a third conveyance amount L3 from this point of time, and the conveying motor MT1, discharge motor MT2, and switchback motor MT4 are stopped (ST05 to ST07). As a result, the sheet S is discharged onto the stack tray 21*b*. The third conveyance amount L3 is obtained by adding a predetermined amount to a conveyance amount corresponding to the moving distance of the rear end Sb of the sheet S between the detection position P1 of the sensor SE and the stack surface of the second stack tray 21*b*.

The above first, second, and third conveyance amounts are each the drive amounts (drive times) of the second conveying roller pair 26 and second discharge roller pair 27. In the present embodiment, the number of pulses corresponding to each of the first, second, and third conveyance amounts is previously set, and the numbers of drive pulses of the conveying motor MT1, discharge motor MT2, and switchback motor MT4 are counted. Then, when the count value reaches the set pulse number, it is detected that the sheet has been conveyed by the designated conveyance amount.

After discharge of the sheet S onto the second stack tray 21*b* and stop of the conveying motor MT1, discharge motor MT2, and switchback motor MT4, the pressure contact motor MT3 is reverse driven by a predetermined amount and stopped (ST08 to ST10). As a result, the upper drive roller 27*a* is moved from the pressure contact position to the waiting position to be separated from the lower drive roller 27*b*.

As described above, the sheet processing apparatus according to the present invention is configured to, in the sheet discharge operation of discharging a sheet onto the second stack tray 21*b* in the non-stapling mode, make the front end of the sheet pass the second discharge roller pair 27 which is in a separated state and bring the second discharge roller pair 27 into a pressure contact state after the front end of the sheet passes the second discharge roller pair 27. This allows the sheet to be smoothly discharged. Further, the timing at which the sheet is nipped by the second discharge roller pair 27 can be changed according to the type of a sheet to be discharged. Specifically, in a case where the sheet type is an envelope having a flap part, the second discharge roller pair 27 is brought into a pressure contact state before the front end of the envelope reaches the second stack tray 21*b*. Thus, even when the sheet type is an envelope, the sheets on the stack tray 21*b* can remain in alignment.

This application is based upon and claims the benefit of priority from prior Japanese Patent Application No. 2020-149890 filed Sep. 7, 2020, the entire contents of which are incorporated herein by reference.

What is claimed is:

1. A sheet processing apparatus for processing a sheet, comprising:

a conveying roller pair;

a stack tray on which a sheet is stacked;

a discharge roller pair composed of first and second rollers and configured to discharge a sheet from the conveying roller pair onto the stack tray in a discharge direction, the second roller being configured to be movable between a pressure contact position to nip the sheet from the conveying roller pair with the first roller and a retracting position to separate from the first roller inclusive; and a pressure contact/separation mechanism for moving the second roller to the retracting position and to the pressure contact position, wherein the pressure contact/separation mechanism is arranged such that when the sheet to be discharged is a sheet of a predetermined type, the pressure contact/separation mechanism makes a front end of the sheet in the discharge direction pass the discharge roller pair in a state where the second roller is in the retracting position, and makes the second roller reach the pressure contact position before the sheet front end reaches the stack tray and a sheet rear end in the discharge direction passes the conveying roller pair, and when the sheet to be discharged is a sheet other than the sheet of the predetermined type, the pressure contact/separation mechanism makes the front end of the sheet pass the discharge roller pair in a state where the second roller is in the retracting position, and makes the second roller reach the pressure contact position after the sheet front end reaches the stack tray and before the sheet rear end passes the conveying roller pair.

2. The sheet processing apparatus according to claim 1, wherein the sheet of the predetermined type is a sheet of one specified type.

3. The sheet processing apparatus according to claim 1, wherein the sheet of the predetermined type is an envelope having a flap part, and the discharge roller pair composed of the first and second rollers contacts the envelope before a front end of the envelope reaches the stack tray.

4. The sheet processing apparatus according to claim 1, wherein when the sheet to be discharged is the sheet of the predetermined type, the pressure contact/separation mechanism starts moving the second roller from the retracting position before the sheet front end reaches a position of the first roller.

5. A sheet processing apparatus for processing a sheet, comprising:

a processing tray for applying post-processing to a sheet;

a post-processing unit disposed on one end side of the processing tray and configured to apply post-processing to a sheet located at a stapling position on the processing tray;

a conveying roller pair disposed above the processing tray and configured to convey a sheet onto the processing tray;

a discharge roller pair configured to be brought in a pressure contact state and in a separated state, the discharge roller pair being disposed on the other end side of the processing tray and configured to discharge a sheet that has been subjected to post-processing on the processing tray and a sheet from the conveying roller pair in a discharge direction;

a stack tray on which a sheet discharged by the discharge roller pair is stacked; and a control part that executes a stapling mode to apply post-processing to a sheet and then discharge the resultant sheet onto the stack tray and a non-stapling mode to discharge a sheet onto the stack tray without applying post-processing to the sheet, wherein when a sheet to be discharged is a sheet of a predetermined type in the non-stapling mode, the control part makes a front end of the sheet in the discharge direction pass the discharge roller pair in the separated state and brings the discharge roller pair into the pressure contact state before the sheet front end reaches the stack tray, when the sheet to be discharged is a sheet other than the sheet of the predetermined type in the non-stapling mode, the control part makes the front end of the sheet pass the discharge roller pair in the separated state and brings the discharge roller pair into the pressure contact state after the sheet front end reaches the stack tray, and in the stapling mode, the control part makes the sheet front end pass the discharge roller pair in the separated state and brings the discharge roller pair into a pressure contact state after the sheet is conveyed onto the processing tray.

6. The sheet processing apparatus according to claim 5, wherein the discharge roller pair is configured to be rotated in forward and reverse directions, and the control part rotates the discharge roller pair in the forward direction to discharge a sheet onto the stack tray and rotates the discharge roller pair in the reverse direction to move a sheet to the stapling position on the processing tray.

7. The sheet processing apparatus according to claim 5, wherein the sheet of the predetermined type is an envelope having a flap part.

8. A sheet processing apparatus for processing a sheet, comprising:

a processing tray for applying post-processing to a sheet;

a binding unit for binding processing to sheets on the processing tray;

a conveying roller pair to convey a sheet onto the processing tray;

a stack tray for stacking a sheet;

a discharge roller pair composed of a first roller, and a second roller configured to be movable between a pressure contact position to nip sheets or a sheet with the first roller and a retracting position to separate from the first roller inclusive, the discharge roller pair being configured to discharge sheets by bind-processed on the processing tray and a sheet from the conveying roller pair, onto the stack tray in a discharge direction; and a control part that executes a binding mode to discharge sheets onto the stack tray after bind-processing the sheets, and a non-binding mode to discharge a sheet onto the stack tray without bind-processing the sheet, wherein the control part, in the non-binding mode, when a sheet is a first type of a sheet, at a timing when a front end of the sheet in the discharge direction arrives at a first position, makes the second roller arrive at the pressure contact position, and when a sheet is a second type of a sheet, at a timing when the front end of the sheet arrives at a second position at a downstream side of the first position in the discharge direction, makes the second roller to the pressure contact position.

9. The sheet processing apparatus according to claim 8, wherein in the non-binding mode, the control part:

in case the sheet to be discharged is the first type of the sheet, makes the front end of the sheet pass in a state where the second roller is separated from the first roller, and brings the second roller into the pressure contact position before the sheet front end reaches the stack tray and before a rear end of the sheet passes the conveying roller pair, and in case the sheet to be discharged is the second type of the sheet, makes the front end of the sheet pass in a state where the second roller is separated from the first roller, and brings the second roller into the pressure contact position after the front end of the sheet reaches the stack tray and before the rear end of the sheet passes the conveying roller pair.

10. The sheet processing apparatus according to claim 9, wherein the first type of the sheet is an envelope, and the second type of the sheet is a plain sheet.

11. The sheet processing apparatus according to claim 8, further comprising:

a sheet sensor for detecting the front end of the sheet, arranged at an upstream side of the conveying roller pair, wherein the control part, in the non-binding mode, in case a sheet is the first type of the sheet, when the sheet is transferred for a first distance from a point when the sheet sensor detects the front end of the sheet, makes the second roller to start moving to the pressure contact position, and in case the sheet is the second type of the sheet, when the sheet is transferred for a second distance from a point when the sheet sensor detects the front end of the sheet, makes the second roller to start moving to the pressure contact position.

* * * * *